US011582550B1

(12) United States Patent
Dominijanni et al.

(10) Patent No.: US 11,582,550 B1
(45) Date of Patent: Feb. 14, 2023

(54) PORT PLACEMENT FOR IN-EAR WEARABLE WITH ACTIVE NOISE CANCELLATION

(71) Applicant: Bose Corporation, Framingham, MA (US)

(72) Inventors: Andrew D. Dominijanni, Waltham, MA (US); Michael J. Daley, Shrewsbury, MA (US); Liam R. Kelly, Milton, MA (US)

(73) Assignee: Bose Corporation, Framingham, MA (US)

( * ) Notice: Subject to any disclaimer, the term of this patent is extended or adjusted under 35 U.S.C. 154(b) by 14 days.

(21) Appl. No.: 17/445,564

(22) Filed: Aug. 20, 2021

(51) Int. Cl.
*H04R 1/10* (2006.01)

(52) U.S. Cl.
CPC ..... *H04R 1/1083* (2013.01); *H04R 1/1016* (2013.01)

(58) Field of Classification Search
CPC ..... H04R 1/1083; H04R 1/1016
USPC ..... 381/94.1
See application file for complete search history.

(56) References Cited

U.S. PATENT DOCUMENTS

| | | | | |
|---|---|---|---|---|
| 7,499,555 | B1 | 3/2009 | Isvan | |
| 10,475,435 | B1 * | 11/2019 | Dominijanni | H04R 1/1041 |
| 2010/0272276 | A1 * | 10/2010 | Carreras | H04R 1/1008 381/71.8 |
| 2013/0028434 | A1 | 1/2013 | Sibbald et al. | |
| 2018/0020281 | A1 | 1/2018 | Wurtz et al. | |
| 2021/0266658 | A1 * | 8/2021 | Wen | G10L 25/51 |
| 2022/0191626 | A1 * | 6/2022 | Dominijanni | H04R 25/402 |

FOREIGN PATENT DOCUMENTS

EP 3637789 A1 4/2020

OTHER PUBLICATIONS

The International Search Report and the Written Opinion of the International Searching Authority, PCT Application No. PCT/US2022/075125, dated Dec. 13, 2022, pp. 1-12.

* cited by examiner

*Primary Examiner* — Paul Kim
*Assistant Examiner* — Friedrich Fahnert
(74) *Attorney, Agent, or Firm* — Bond, Schoeneck & King, PLLC

(57) ABSTRACT

An in-ear wearable that can include an electro-acoustic transducer; a housing supporting the electro-acoustic transducer such that the housing and the electro-acoustic transducer together defining an acoustic volume, a feedback microphone disposed within the acoustic volume to receive the acoustic energy, the feedback microphone including a microphone port, the feedback microphone transducing acoustic energy received at the microphone port into a feedback microphone signal; and a port defined within the housing, the port extending from a first opening to a second opening, wherein the port acoustically couples the acoustic volume to a space outside the housing such that outside acoustic energy from the space outside the housing enters the first acoustic volume through a path that does not pass through the second acoustic volume, wherein the first opening does not extend beyond a first plane tangent to a point of the microphone port nearest to acoustic exit port and orthogonal to a longitudinal axis of the housing.

21 Claims, 8 Drawing Sheets

PORT PLACEMENT FOR IN-EAR WEARABLE WITH ACTIVE NOISE CANCELLATION

BACKGROUND

The present disclosure generally relates to in-ear wearables having ports placed to optimize active noise cancellation.

SUMMARY

All examples and features mentioned below can be combined in any technically possible way.

According to an aspect, an in-ear wearable includes an electro-acoustic transducer; a housing supporting the electro-acoustic transducer such that the housing and the electro-acoustic transducer together define a first acoustic volume, the electro-acoustic transducer being arranged such that a first radiating surface of the electro-acoustic transducer radiates first acoustic energy into the first acoustic volume, wherein the housing and the electro-acoustic transducer together define a second acoustic volume, wherein a second radiating surface of the electro-acoustic transducer radiates second acoustic energy into the second acoustic volume, wherein the housing further defines an acoustic exit port positioned to direct the first acoustic energy into a user's ear when the housing is worn; a feedback microphone disposed within the first acoustic volume to receive the first acoustic energy, the feedback microphone including a microphone port and being configured to transduce acoustic energy received at the microphone port into a feedback microphone signal; and a port defined within the housing, the port extending from a first opening to a second opening, the first opening defining a boundary between the port and the first acoustic volume, wherein the port acoustically couples the acoustic volume to a space outside the housing such that outside acoustic energy from the space outside the housing enters the first acoustic volume through a path that does not pass through the second acoustic volume, wherein the first opening does not extend beyond a first plane tangent to a point of the microphone port nearest to the acoustic exit port and orthogonal to a longitudinal axis of the housing.

In an example, the first opening extends through a second plane tangent to a point of the radiating surface nearest to the feedback microphone and orthogonal to the longitudinal axis of the housing.

In an example, the first opening does not extend through a second plane tangent to a point of the radiating surface nearest to the feedback microphone and orthogonal to the longitudinal axis of the housing.

In an example, the first opening extends at least partly between the first plane and a second plane tangent to a point of the radiating surface nearest to the feedback microphone and orthogonal to the longitudinal axis of the housing.

In an example, the first opening intersects the first plane.

In an example, the port is at least partly defined by a tube extending within the housing.

In an example, the port is at least partly defined by the housing.

In an example, the first opening is defined in an inner surface of an exterior wall of the housing.

In an example, the second opening is defined in an exterior surface of an exterior wall of the housing.

In an example, the second opening is at least partly defined in an exterior surface of an exterior wall of the housing.

In an example, the port is at least partly defined between an interior wall of the housing and an exterior wall of the housing.

In an example, the second opening defines the boundary between the port and a third acoustic volume, the third acoustic volume being acoustically coupled to the space outside of the housing.

In an example, the third acoustic volume opens to the space outside of the housing.

In an example, the in-ear wearable further includes a second port extending from the third acoustic volume to the second acoustic volume, such that the second acoustic volume is acoustically coupled to the space outside of the housing.

In an example, the in-ear wearable is a hearing aid, the electro-acoustic transducer transducing a signal from a microphone.

In an example, the microphone is disposed within the housing.

In an example, the microphone is disposed within a casing configured to sit behind a user's pinna when worn.

In an example, the in-ear wearable is an in-ear headphone.

In an example, the port is at least partially covered with a mesh.

In an example, the in-ear wearable further includes a sound processor, generating a noise-cancellation signal that is provided to the electro-acoustic transducer, wherein the noise-cancellation signal is based, at least in part, on the feedback microphone signal.

In an example, the noise-cancellation signal is further based on a signal from a feedforward microphone.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

Figure 1:
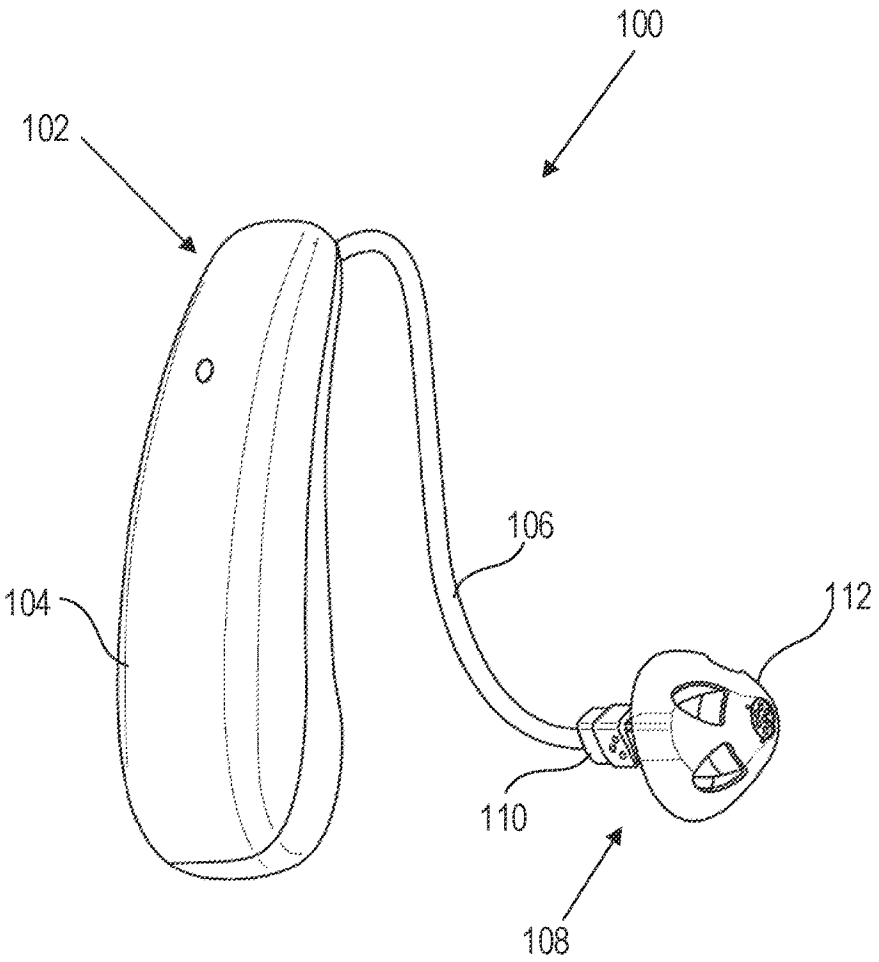
FIG. 1 depicts a perspective view of a hearing aid, according to an example.

With reference to FIG. 1, a receiver-in-canal (MC) hearing aid 100 is shown. Hearing aid 100 includes a behind-the-ear portion 102 that includes a battery, a microphone, and a sound processor housed in a casing 104 designed to sit behind a user's ear (pinna). This behind-the-ear portion 102 of the hearing aid 100 has a small wire 106 designed to run around the user's ear and into an earpiece 108 that is designed to sit in the user's ear canal. The earpiece 108 includes an earbud 110 that carries an electro-acoustic transducer, also known as the "speaker", "receiver," or "driver." Conventional MC style hearing aids often further include a compliant tip 112 on the ear bud 108 for engaging the user's ear canal, which helps to keep earpiece 110 in place within the user's ear canal.

The microphone receives sounds from the environment and produces a microphone signal, which is typically amplified and processed by the sound processor, before being provided to the driver for transduction into an acoustic signal to the user. Hearing aid 100 can further include a feedback microphone, which receives the acoustic signal of the driver and undesired ambient noise. The signal from the feedback microphone is used to generate a noise-cancellation signal that is played through the speaker in addition to the microphone signal. The noise-cancellation signal is approximately 180° out of phase with the undesired noise, and thus destructively interferes with the undesired noise (resulting in a reduction in undesired noise, as perceived by the user, of at least 3 dB).

Many hearing aids, and other in-ear wearables, suffer from what is known as the occlusion effect. The occlusion effect amplifies lower-frequency components of the user's own voice due to the acoustic blockage of the ear canal. As a result, vibrations due to the user's voice travel through the head and into the ear canal. When the ear is not occluded, the associated pressure escapes out of the ear; when the ear is occluded, and the pressure cannot escape, low-frequency components are grossly amplified inside the user's ear. Occluding the ear causes an additional problem—blocking of the ear canal prevents higher frequency components of the user's voice from traveling around the head and back in the ear. These two issues result in undesirable own-voice quality, typically perceived as the user's voice being "boomy" or "muffled." Here, "own-voice" refers to the user's perception of their own voice while speaking. Low-occlusion in-ear devices typically have a leak path, referred to in this disclosure as a "port," from the ear canal to outside the device and ear canal. This leak reduces product-generated low frequency pressures that can reach the eardrum.

The manner in which ports introduce noise to the earbud, however, impacts the manner in which a feedback microphone generates the feedback signal for active noise cancellation. Indeed, if the ports are improperly placed within the earbud, the relative pressure between the feedback microphone and the ear canal from external noise will differ from the relative cancellation pressure from the loudspeaker. Accordingly, there exists a need in the art for port placement, relative to the feedback microphone, to permit the active noise cancellation to accurately reduce the noise perceived by the user, by matching the relative pressures from both external noise and the loudspeaker.

While the various examples described in this disclosure are directed toward a hearing aid, it should be understood that the port placements and other features described herein can be used in conjunction with any in-ear wearable (e.g., in-ear headphones) that might otherwise suffer from an occlusion effect. (FIGS. 2 and 4, described below, could alternately be considered cross-sections of in-ear headphones.) Indeed, the port placements and other features described herein can be used with any such appropriate audio/entertainment devices, as well as various hearing aid form factors such as in-the-ear and in-the-canal.

Figure 2:
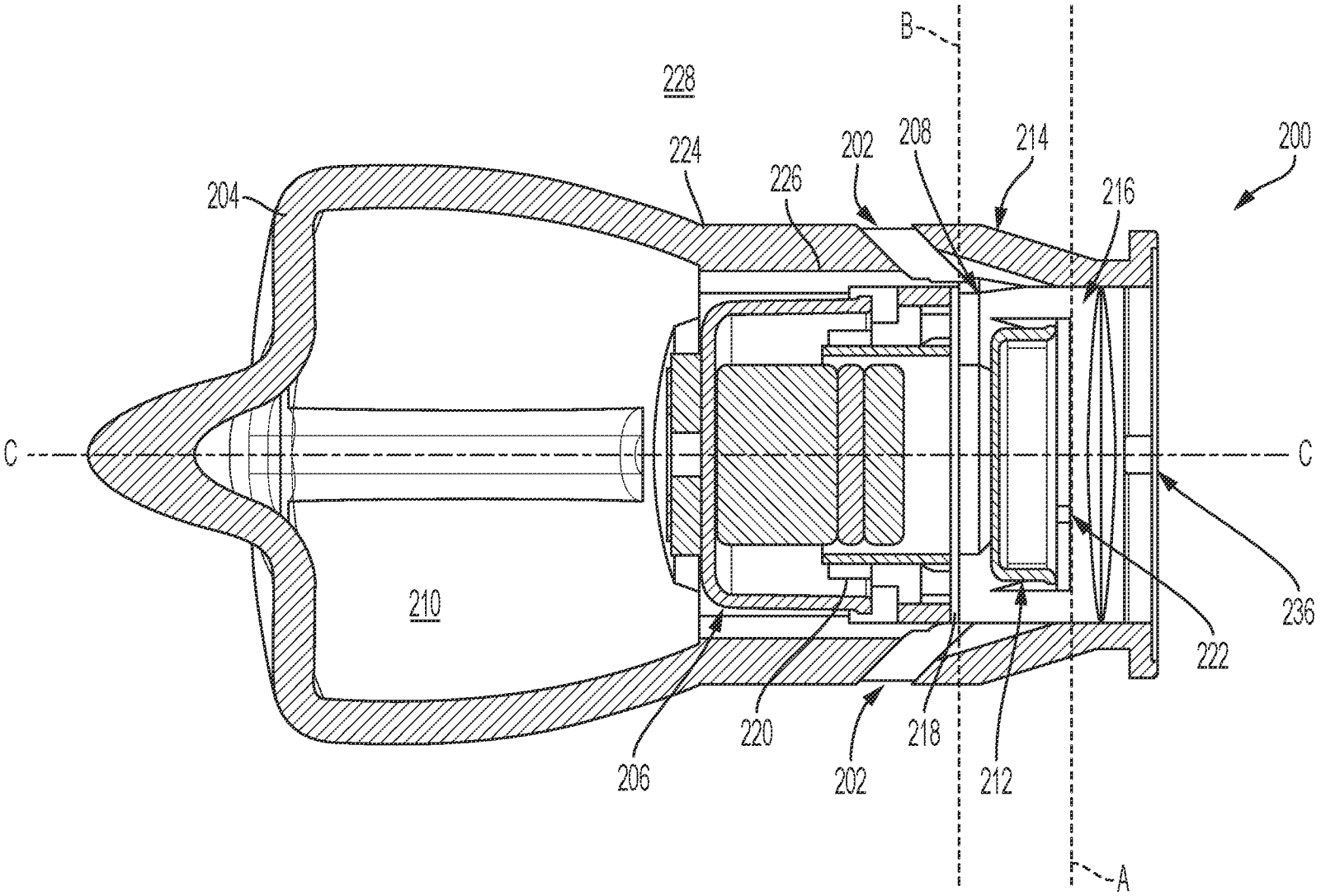
FIG. 2 depicts a cross-section view of an earbud, according to an example.

FIG. 2 depicts a cross-section of an earbud 200 featuring ports 202 to reduce the occlusion effect. Earbud 200 includes a housing 204 that supports electro-acoustic transducer 206. Together, the housing 204 and the electro-acoustic transducer 206 define a first (front) acoustic volume 208 and a second (rear) acoustic volume 210. (Certain examples, however, include only the first volume.) The electro-acoustic transducer 206 is arranged such that a first (front) radiating surface of the electro-acoustic transducer 206 radiates an acoustic signal into the first acoustic volume 208, and such that a second (rear) radiating surface of electro-acoustic transducer 206 radiates acoustic energy into the second acoustic volume 210. First acoustic volume 208 is sealed by electro-acoustic transducer 206 (and an interior wall, in some examples) from second acoustic volume 210. Earbud 200 further includes a feedback microphone 212 disposed in first acoustic volume 208.

Housing 204 can be of unitary construction or can be formed of multiple pieces assembled together. Further, as will be described in detail below, in addition to an exterior wall 238 (which itself can be formed from multiple assembled pieces), housing 204 can further include interior walls that can, among other things, support the electro-acoustic transducer 206 and/or at least partly define ports that reduce the occlusion effect.

Housing 204 can also define a nozzle 214 that is configured to be coupled to an ear tip. In this example, first acoustic volume 208 narrows to form the acoustic passage 216 in the nozzle 214. However, implementations where the ear tip is supported by the housing 204 without the inclusion of a nozzle 214 are contemplated. At the front of first acoustic volume 208 (regardless of whether nozzle 214 is included) there is an acoustic exit port 236 positioned to direct acoustic energy radiated by the first radiating surface into the user's ear. Feedback microphone 212 is thus positioned between electro-acoustic transducer 206 and acoustic exit port 236.

As shown, electro-acoustic transducer 206 includes a diaphragm that is driven by a voice coil 220 (shown wound about a bobbin) in response to a received signal, e.g., from a sound processor, to produce the acoustic signal within the first acoustic volume 208 and second acoustic volume 210. (The sound processor and any associated electronics can, for example, be disposed within the earbud, or, alternatively, external to the earbud, such as in a behind-the-ear casing or a mobile device.) Feedback microphone 212 includes an acoustic port 222 for receiving the acoustic signal produced by electro-acoustic transducer 206 and any undesired noise within the first acoustic volume 208 and for transducing the received acoustic signal and undesired noise into a feedback signal. The feedback signal is used (e.g., by the sound processor) to generate a noise-cancellation signal that is transduced by electro-acoustic transducer 206 to cancel (i.e., reduce by at least 3 dB) the undesired noise as perceived by the user.

As described above, ports 202 are defined within housing 204 to reduce the occlusion effect experienced by the user. In the example of FIG. 2, ports 202 extend between an outer surface 224 and inner surface 226 of an external wall of housing 204, such that the ports 202 each directly couple the first acoustic volume 208 to a space outside housing 204, here denoted as 228. Stated differently, ports 202 acoustically couple first acoustic volume 208 to the space 228 outside housing 204, such that sound can travel from space outside housing 204 to first acoustic volume 208 without traveling through second acoustic volume 210.

Figure 3A:
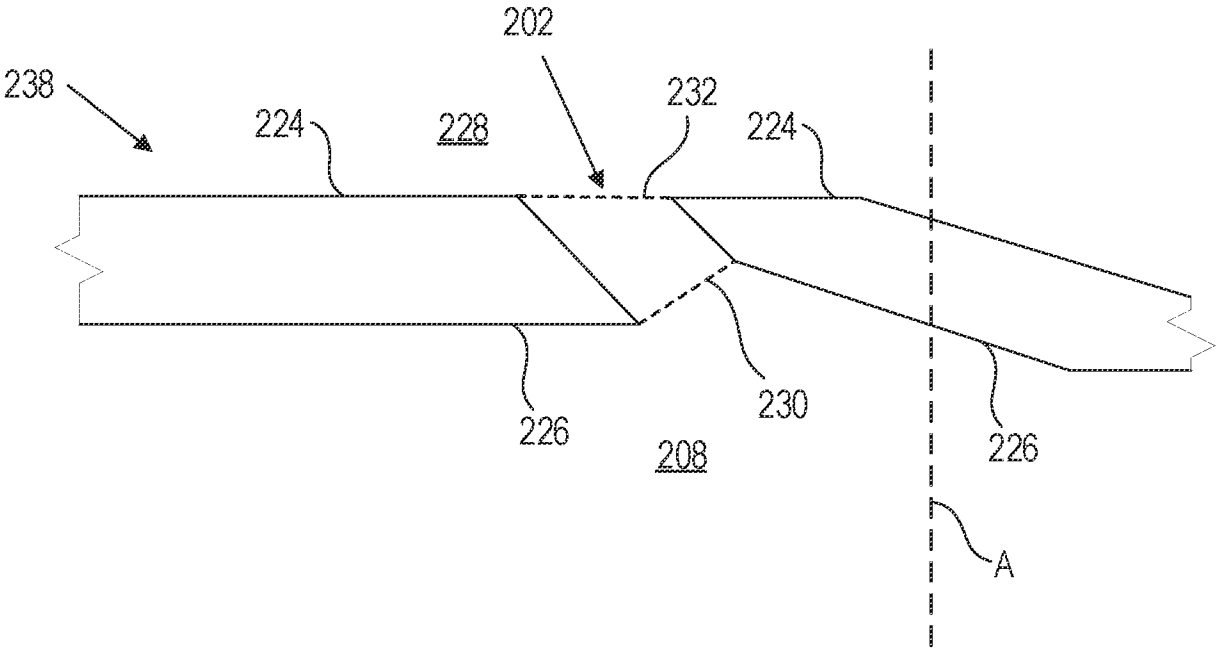
FIG. 3A depicts a cross-section view of a port defined within the housing of an earpiece, according to an example.
Figure 3B:
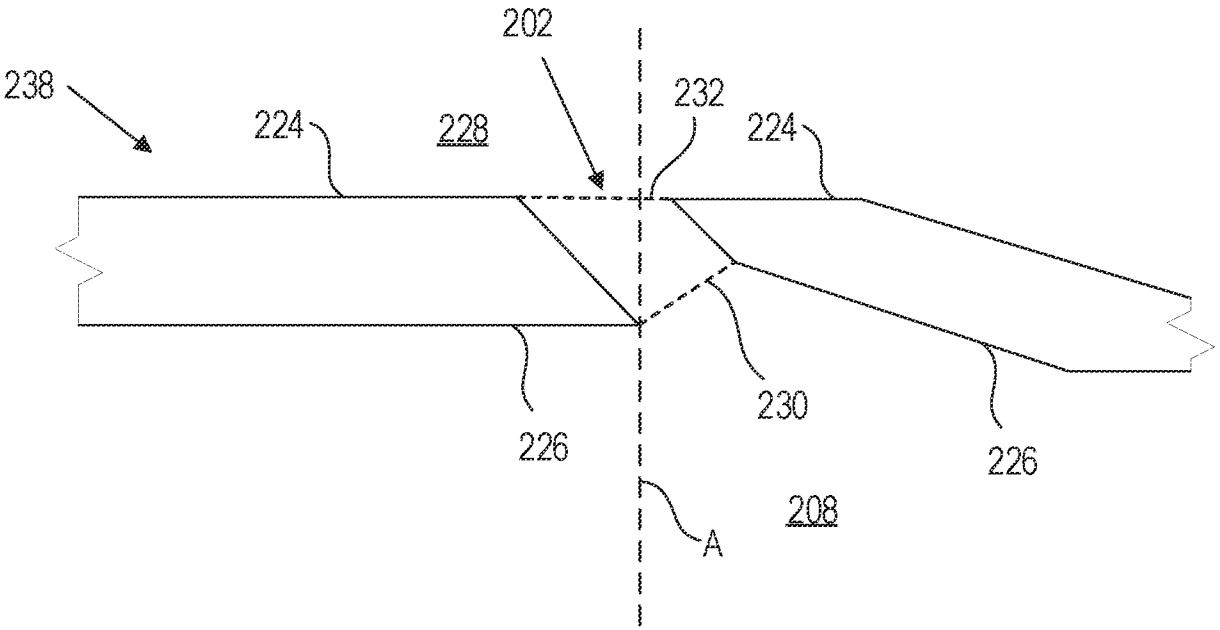
FIG. 3B depicts a cross-section view of a port defined within the housing of an earpiece, according to an example.
Figure 3C:
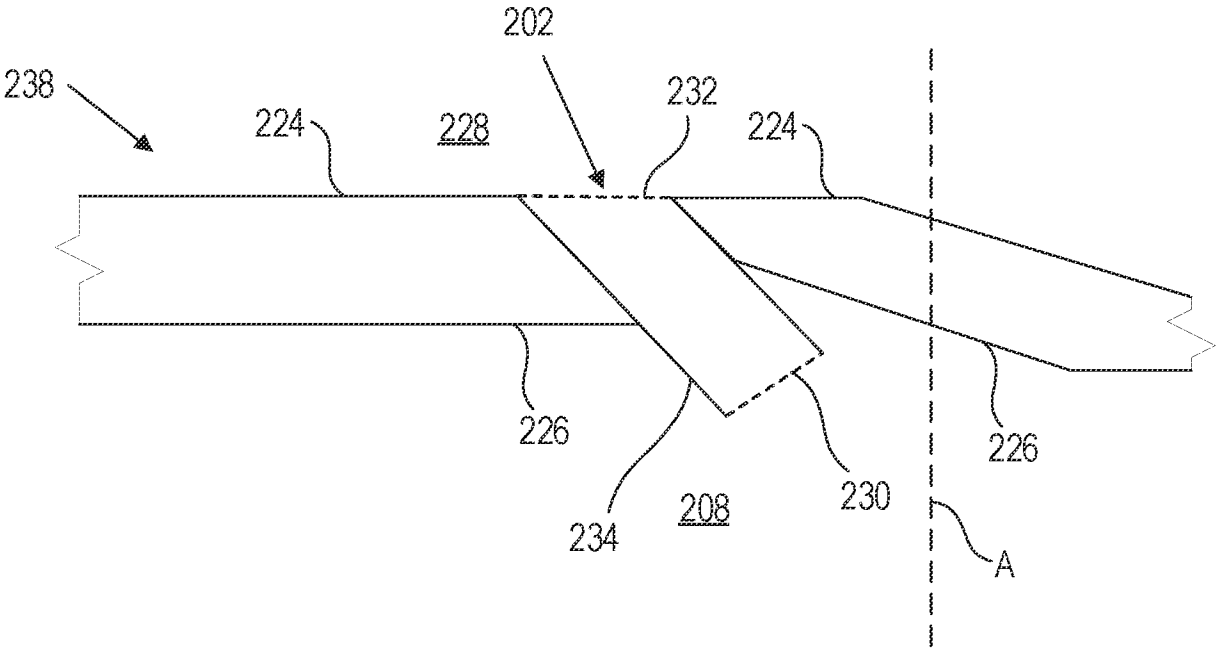
FIG. 3C depicts a cross-section view of a port defined, by a tube, within a housing of an earpiece, according to an example.

One of ports 202 is shown in more detail in FIG. 3A. As shown, port 202 extends from a first opening 230 in the inner surface 226 of an exterior wall 238 of housing 204 to a second opening 232 in the outer surface 224 of an exterior wall of housing 204. The first opening thus defining the boundary between port 202 and first acoustic volume 208 (i.e., where acoustic energy from space 228 enters the acoustic volume 208) and the second opening defining the boundary between port 202 and the space 228 outside of housing 204—or, in alternative examples, to another volume or space acoustically coupled to the space 228 outside of housing (i.e., where acoustic energy from space 228 enters the port 202). Applicant has recognized that, to optimize the active noise cancellation via feedback microphone 212, the path for the ambient noise entering the first acoustic volume 208 from port 202 (e.g., originating at the concha of the user's ear) to feedback microphone 212 should approximate the path from the electro-acoustic transducer 206 to the feedback microphone. To accomplish this, first opening 230 is positioned such that it does not extend beyond a plane that is: (1) tangent to a point of the surface of acoustic port 222 of feedback microphone 212 nearest to acoustic exit port 236 and (2) orthogonal to a longitudinal axis C-C of the housing. Such a plane is denoted as plane A in FIGS. 2-4. (As used in this disclosure, longitudinal axis C-C follows the dimension of insertion of the earbud into the ear canal, as this is typically commensurate with the lengthwise dimension of the earbud. Further, the phrase "does not extend beyond," as used in this disclosure, explicitly contemplates that opening 230 could intersect or extend through plane A; but opening 230 cannot be disposed entirely to the right of plane A in FIG. 2. To "extend beyond" thus refers to the entirety of opening 230 being disposed on the side of plane A nearest to the acoustic exit port 236.) Where, as shown in FIG. 2, the opening of acoustic port 222 faces acoustic exit port 236, then the point nearest to acoustic exit port 236 is the outer edge of acoustic port 222. In alternative examples, acoustic port 222 can be oriented in different directions than as shown in FIG. 2 (e.g., if feedback microphone 212 is oriented in different ways within housing 204). FIG. 3B depicts the maximum extent to which first opening 120 of port 202 can extend through plane A before the performance of the active-noise cancellation begins to deteriorate.

As shown in FIG. 2, in an example, first opening 230 can extend through a plane B defined by diaphragm 218 of electro-acoustic transducer 206. (Because diaphragm 218 is not necessarily planar, plane B is defined as tangent to the point of diaphragm 218 nearest to feedback microphone 212 and orthogonal to longitudinal axis C-C.) Such a positioning of first opening 230 has been shown to result in good noise-cancellation performance. However, port 202 can be defined by housing 204 at any point along to longitudinal axis C-C, as long as first opening 230 does not extend beyond plane A, as defined by the acoustic port 222 of feedback microphone 212 as described above, or extend across the partition between the first acoustic volume 208 and second acoustic volume 210. Indeed, in various examples, first opening 230 can also be defined such that it does not extend through plane B. For example, first opening 230 can be defined between planes A and B or behind plane B (i.e., between plane B and the partition dividing first acoustic volume 208 and second acoustic volume 210). Accordingly, ambient noise entering via ports 202 will be introduced to first acoustic volume 208 and arrive at acoustic port 222 of feedback microphone 212 along a path that approximates the path from electro-acoustic transducer 206 to feedback microphone 212.

As shown in FIGS. 2-3B, the ports acoustically coupling the first acoustic volume to the space outside of the housing to reduce occlusion can be formed as an aperture in housing 204. However, as shown in FIG. 3C, in some examples, the ports can be defined within housing 204, at least in part, by a tube 234. In various examples, tube 234 can be formed integrally with housing 204. Alternatively, or additionally, tube 234 can be made of metal, e.g., stainless steel. For example, port 202 can include a metal tube seated inside an exterior wall 238 of housing 204, such as shown in FIG. 3C. Housing 204 can be made of plastic, and tube 234 can be heat-staked to the plastic. Tube 234 can be substantially straight or can be curved along its length. If tube 234 extends beyond the aperture formed in housing 204 and into first acoustic volume 208, the first opening 230 of port 202 is considered to the opening of tube 234 within the first acoustic volume 208, as this forms the boundary between port 202 and first acoustic volume 208, where acoustic energy from space 228 enters acoustic volume 208. In cross-section, the aperture and/or tube 234 can be circular or non-circular, such as rectangular or semi-circular.

Figure 3D:
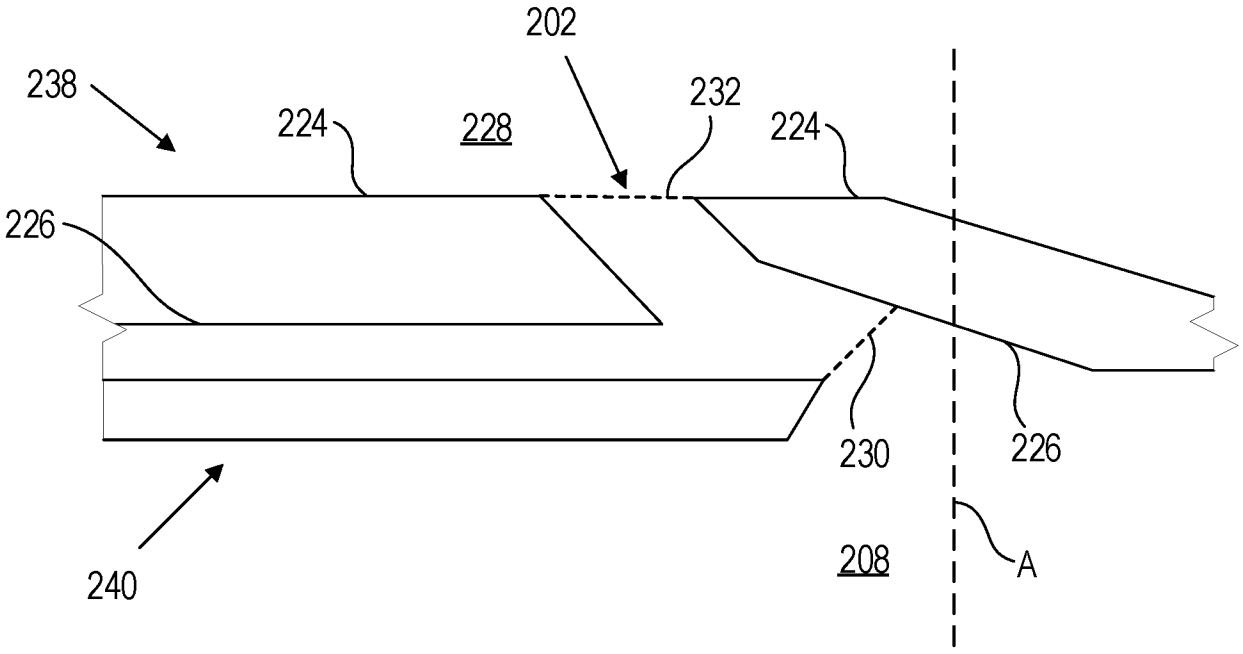
FIG. 3D depicts a cross-section view of a port defined within the housing of an earpiece, according to an example.

In example FIG. 3D, port 202 can further be further defined within housing 204 by an interior wall 240 of housing 204. As shown in this example, an interior wall 240 is disposed between first acoustic volume 208 and the aperture through exterior wall 238 of housing 204, such that port 202 is further defined by the space between the exterior wall 238 of housing 204 and interior wall 240 of housing 204. In this example, the acoustic energy from space 228 outside housing 204 enters the first acoustic volume 230 at a gap between the exterior wall 238 of housing 204 and the interior wall 240 of housing 204. Accordingly, the boundary between port 202 and the first acoustic volume 230, i.e., the first opening 230, in this example, is defined by the gap between interior wall 240 and the exterior wall 238 of housing 204.

Figure 4:
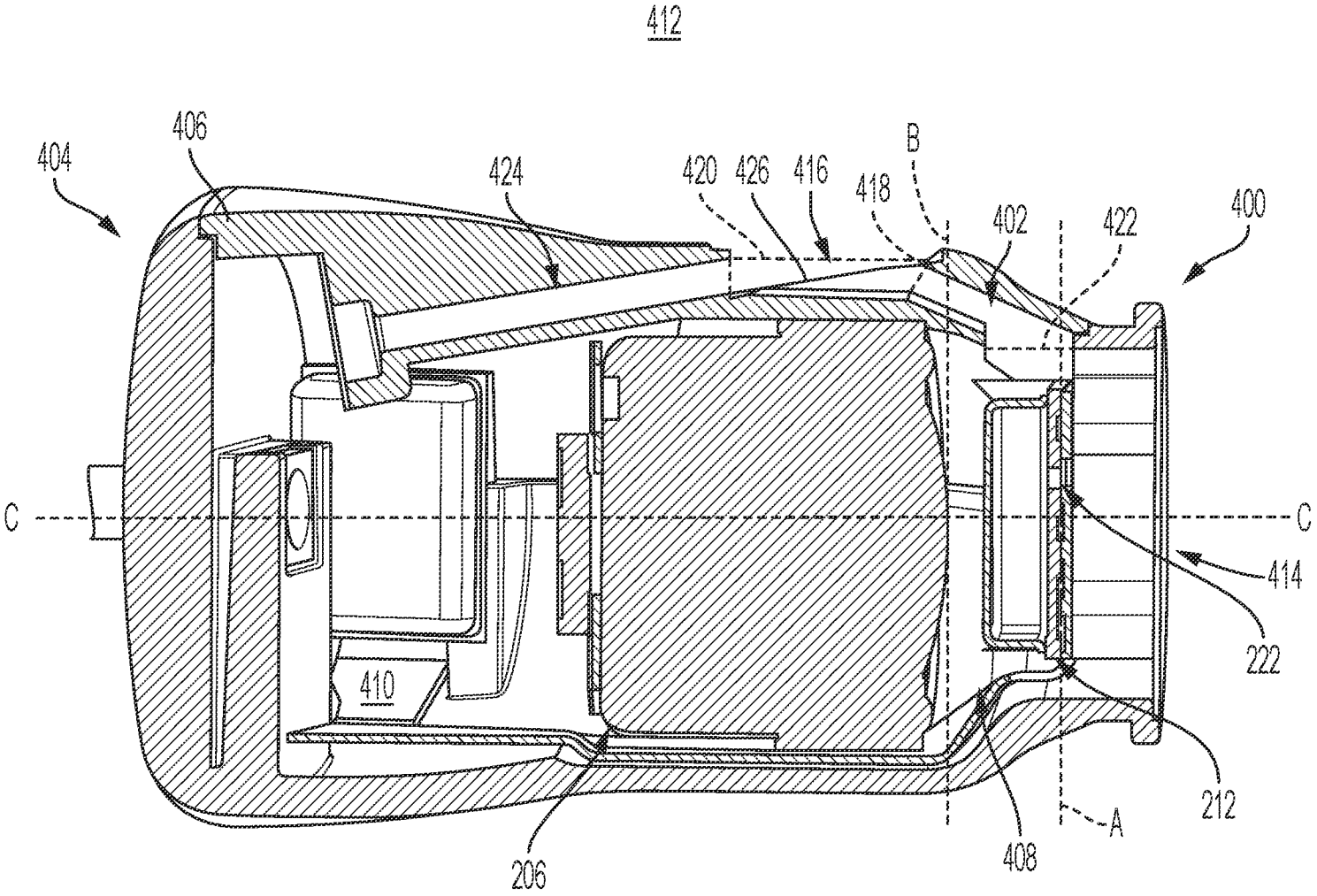
FIG. 4 depicts a cross-section view of an earbud, according to an example.

In an alternative example, the ports acoustically coupling the first acoustic volume to the space outside of the housing to reduce occlusion are acoustically coupled through one or more intermediary volumes. FIG. 4 depicts a cross-section of an earbud 400 with porting to reduce the occlusion effect, according to another example. Like the example of FIG. 2, earbud 400 includes a port 402 defined within a housing 404 to acoustically couple a first acoustic volume 408 to a space 412 outside of the housing. Electro-acoustic transducer 206 is supported within the housing 404 to define the first acoustic volume 408. Electro-acoustic transducer 206 includes a first radiating surface that radiates acoustic energy into the first acoustic volume 408, and which is directed out of acoustic exit port 414. Electro-acoustic transducer 206 further includes a second radiating surface which radiates acoustic energy into second acoustic volume 410. Feedback microphone 212 is disposed in the first acoustic volume between electro-acoustic transducer 206 and acoustic exit port 414.

As shown in FIG. 4, port 402 is defined as an aperture through exterior wall 406 of housing 404. Port 402 extends from volume 416, (i.e., second opening 418 of port 402 defines the boundary between port 402 and volume 416), which opens to the space 412 outside of housing (at opening 420) and is thus acoustically coupled to the space 412 outside housing 404. Accordingly, port 402 is acoustically coupled to the space 412 outside housing 404 via volume 416. Port 402 extends from first opening 422, which defines the boundary from the port 202 to first acoustic volume 408, to the second opening 418 at volume 416. Port 402 thus acoustically couples first acoustic volume 408 to the space 412 outside of the housing 404 through a path that does not travel through the second acoustic volume 410. In alternative examples, a series of volumes/ports can acoustically couple the port 402 to the space 412 outside of housing 404, the series of volumes/ports together defining an acoustic path that does not travel through the second acoustic volume 410. The first opening 422 of port 402, like the example of FIGS. 2A-3C, does not extend beyond a plane A tangent to the point of the surface of acoustic port 222 of feedback microphone 212 nearest to acoustic exit port 414 and orthogonal to a longitudinal axis C-C of the housing 404 (which, again, follows the dimension of insertion of earbud 400). Port 402 thus defines a path for ambient noise external to the housing 404 to travel to the first acoustic volume 408 without passing through the second acoustic volume 410 and generally approximates the path from the electro-acoustic transducer 206 to feedback microphone 212.

In addition to port 402, a port 424 acoustically couples second acoustic volume 410 to the space 412 outside of housing 404. Further, ports within the eartip or elsewhere within the housing can be defined to further reduce occlusion. In addition, although only two ports coupling the first acoustic volume to the space outside the housing are shown in FIG. 2, and only one port shown in FIG. 4, it should be understood that any suitable number of such ports can be employed to reduce occlusion.

In various examples, openings or other parts of ports or volumes, as described herein, can be covered with a sound-permeable material to prevent the port or volume from becoming clogged with earwax or other substances. Such sound-permeable materials include a mesh (e.g., a metal screen) although other materials are contemplated. One example of a such a sound-permeable material is mesh 426 which extends diagonally across volume 416 to prevent the buildup of earwax therein. Other examples include placing sound-permeable materials across first openings 230, 422, second openings 232, 418, or elsewhere in ports 202, 402, or housings 204, 404.

As described above, ports that acoustically couple the space outside of the housing to the first acoustic volume can be defined within the housing by apertures through the exterior wall of the housing, by tubes, between an interior wall and an exterior wall (or, alternatively, between interior walls), or some combination thereof. Further, the ports can be acoustically coupled to the space outside of the housing through one or more intermediary volumes, to which other ports can be acoustically coupled.

Figure 5:
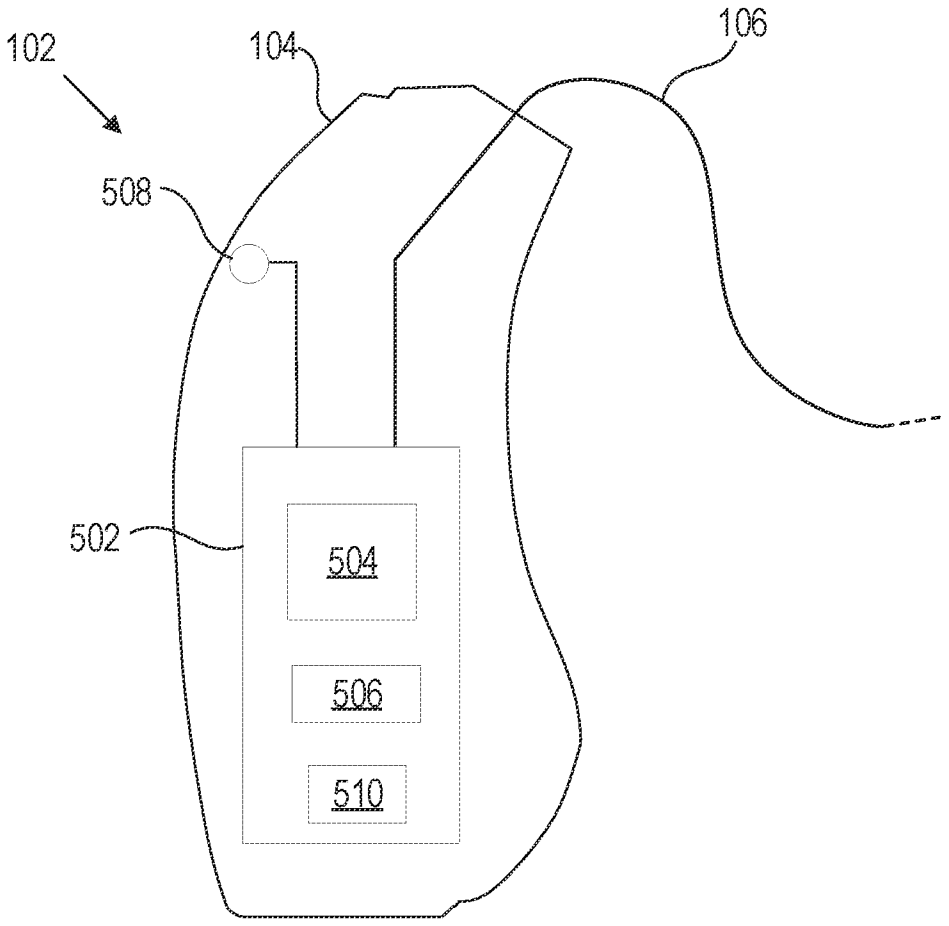
FIG. 5 depicts a schematic view of a behind-the-ear portion of a hearing aid, according to an example.

FIG. 5 depicts an example of a schematic diagram of the behind-the-ear portion 102 designed to sit behind a user's ear (pinna), used in the behind-the-ear form factor example. In this example, behind-the-ear portion 102 includes a casing 104 that houses electronics 502, including, at least a sound processor 504 and a battery 506 for powering sound processor 504 and the remainder of electronics 502, and a microphone 508. In some cases, microphone 508 can include a plurality of microphones that can be arranged in an array. In the hearing aid example, sound processor 504 receives signals from microphone 508 and performs one or more processing operations including beam steering, null forming, gain, compression, and/or active noise cancellation (including feedback active noise cancellation, employing signals received from, at least, feedback microphone 212, and, in certain examples, feedforward active noise cancellation using signals from microphone 508 or other microphones).

Sound processor 504 can be implemented as one or more separate or analog and digital processors. To perform the various operations described above (including beam steering, null forming, gain, compression, active noise cancellation) sound processor 504 can execute instructions stored in a non-transitory storage medium. In various examples, the sound processor 504 can implement one or more adaptive filters, such as a least means squares (LMS) adaptive filter or a recursive least squares filter (RLS) adaptive filter, to perform the adaptive active noise cancellation algorithm. These adaptive filters can employ the signal from the feedback microphone 212 as an error signal, as will be understood by a person of ordinary skill in the art. Sound processor 504 generates a noise-cancellation signal that is provided to the electro-acoustic transducer 206, such that the electro-acoustic transducer 206 renders an acoustic noise-cancellation signal that deconstructively interferes with undesired noise in the user's ear canal and the user perceives a reduction in the undesired noise. Additionally, the signal from microphone 508, or from another microphone, can be employed by sound processor 504 in a feedforward active noise cancellation algorithm to cancel undesired noise as perceived by the user.

Electronics 502 can also include a transceiver circuit 510. The transceiver circuit 510 can transmit and receive wireless signals, including receive streaming audio (e.g., high fidelity audio) for rendering by the electro-acoustic transducer 206. The transceiver circuit 510 can communicate wirelessly with a data source such as a smartphone or any other suitable digital audio playing device, such as a laptop or personal computer, that stores and/or plays digital audio files. The transceiver circuit 510 can alternatively or additionally be configured to communicate with a second, companion hearing aid, e.g., for transmitting digital audio content between the two hearing aids, e.g., for stereo playback or beamforming. The transceiver circuit 510 can communicate, e.g., with the data source or a second, companion hearing aid, using any suitable wireless communication protocol, including Bluetooth, Bluetooth Low Energy (BLE), Wi-Fi (e.g., IEEE 802.11alb/g/n), WiMAX (e.g., IEEE 802.16), Zigbee, UWB, NFMI, or any other suitable wireless communication protocol.

The transceiver circuit 510 can also enable communication with a software application running on a computing device, such as a smart phone. The software application can be used for self-tuning to allow a user to adjust DSP filters to tune audio (either high fidelity audio coming from an audio data source or audio delivered from the microphone 508, which, as described above, can be microphone array).

The electronics 502 can further include an audio amplifier, an analog-to-digital (A/D) converter, e.g., for converting an analog microphone signal to digital form, a digital-to-analog (D/A) converter, e.g., for converting a digital audio signal to analog form for transduction by the electro-acoustic transducer 206, and a microcontroller for controlling operation of the various electronic components. Behind-the-ear portion 102 of the hearing aid 100 includes wiring 106 designed to run around the user's ear and into the earpiece 110. Wiring 106 can include a plurality of wires carried in a common conduit (e.g., a sheath or tube) that runs between the earpiece and the behind-the-ear portion. Wiring 106 drives the electro-acoustic transducer 206. The wiring 106 can also be used to couple the electronics 502 to feedback microphone 212.

In an alternative example, some or all of electronics 502 and/or sound processor 504 can be housed within earpiece 110 or earbud 108 (in one such example, behind-the-ear portion 102 can thus be excluded), or can be distributed between behind-the-ear portion 102, earpiece 110, or a housing attached to earpiece 110. For example, in in-the-ear or the in-the-canal form factors, electronics 502 and sound processor 504 can be positioned within the housing of the earpiece, either in the earbud or in the casing adjacent to the concha of the user's ear when worn. Further, in non-hearingaid examples, such as an in-the-ear headphone, sound processor 504 (which performs functions related to active noise cancellation and/or delivering and audio signal rather than a signal from a dedicated microphone) and/or electronics 502 can be positioned within the housing of the device (e.g., in a portion inserted into the user's ear canal or that is adjacent to the user's concha).

The functionality described herein, or portions thereof, and its various modifications (hereinafter "the functions") can be implemented, at least in part, via computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of selecting or combining the reference signals. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random-access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments can be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. An in-ear wearable comprising:

an electro-acoustic transducer;

a housing supporting the electro-acoustic transducer such that the housing and the electro-acoustic transducer together define a first acoustic volume, the electro-acoustic transducer being arranged such that a first radiating surface of the electro-acoustic transducer radiates first acoustic energy into the first acoustic volume, wherein the housing and the electro-acoustic transducer together define a second acoustic volume, wherein a second radiating surface of the electro-acoustic transducer radiates second acoustic energy into the second acoustic volume, wherein the housing further defines an acoustic exit port positioned to direct the first acoustic energy into a user's ear when the housing is worn;

a feedback microphone disposed within the first acoustic volume to receive the first acoustic energy, the feedback microphone including a microphone port and being configured to transduce acoustic energy received at the microphone port into a feedback microphone signal; and a port defined within the housing, the port extending from a first opening to a second opening, the first opening defining a boundary between the port and the first acoustic volume, wherein the port acoustically couples the acoustic volume to a space outside the housing such that outside acoustic energy from the space outside the housing enters the first acoustic volume through a path that does not pass through the second acoustic volume, wherein the first opening does not extend beyond a first plane tangent to a point of the microphone port nearest to the acoustic exit port and orthogonal to a longitudinal axis of the housing.

2. The in-ear wearable of claim 1, wherein the first opening extends through a second plane tangent to a point of the radiating surface nearest to the feedback microphone and orthogonal to the longitudinal axis of the housing.

3. The in-ear wearable of claim 1, wherein the first opening does not extend through a second plane tangent to a point of the radiating surface nearest to the feedback microphone and orthogonal to the longitudinal axis of the housing.

4. The in-ear wearable of claim 1, wherein the first opening extends at least partly between the first plane and a second plane tangent to a point of the radiating surface nearest to the feedback microphone and orthogonal to the longitudinal axis of the housing.

5. The in-ear wearable of claim 4, wherein the first opening intersects the first plane.

6. The in-ear wearable of claim 1, wherein the port is at least partly defined by a tube extending within the housing.

7. The in-ear wearable of claim 1, wherein the port is at least partly defined by the housing.

8. The in-ear wearable of claim 7, wherein the first opening is defined in an inner surface of an exterior wall of the housing.

9. The in-ear wearable of claim 8, wherein the second opening is defined in an exterior surface of an exterior wall of the housing.

10. The in-ear wearable of claim 7, wherein the second opening is at least partly defined in an exterior surface of an exterior wall of the housing.

11. The in-ear wearable of claim 7, wherein the port is at least partly defined between an interior wall of the housing and an exterior wall of the housing.

12. The in-ear wearable of claim 1, wherein the second opening defines the boundary between the port and a third acoustic volume, the third acoustic volume being acoustically coupled to the space outside of the housing.

13. The in-ear wearable of claim 12, wherein the third acoustic volume opens to the space outside of the housing.

14. The in-ear wearable of claim 12, further comprising a second port extending from the third acoustic volume to the second acoustic volume, such that the second acoustic volume is acoustically coupled to the space outside of the housing.

15. The in-ear wearable of claim 1, wherein the in-ear wearable is a hearing aid, the electro-acoustic transducer transducing a signal from a microphone.

16. The in-ear wearable of claim 1, wherein the microphone is disposed within the housing.

17. The in-ear wearable of claim 1, wherein the microphone is disposed within a casing configured to sit behind a user's pinna when worn.

18. The in-ear wearable of claim 1, wherein the in-ear wearable is an in-ear headphone.

19. The in-ear wearable of claim 1, wherein the port is at least partially covered with a mesh.

20. The in-ear wearable of claim 1, further comprising a sound processor, generating a noise-cancellation signal that is provided to the electro-acoustic transducer, wherein the noise-cancellation signal is based, at least in part, on the feedback microphone signal.

21. The in-ear wearable of claim 20, wherein the noise-cancellation signal is further based on a signal from a feedforward microphone.

* * * * *